US005462321A

United States Patent [19]

Osborn

[11] Patent Number: 5,462,321

[45] Date of Patent: Oct. 31, 1995

[54] AUXILIARY DOOR LOCK FOR AN OUTWARDLY OPENING DOOR

[76] Inventor: Lloyd J. Osborn, Rte. 1, Box 634, Camp, Ark. 72520

[21] Appl. No.: 195,208

[22] Filed: Feb. 14, 1994

[51] Int. Cl.[6] ..... E05C 19/18

[52] U.S. Cl. ..... 292/288; 292/256.71; 292/291

[58] Field of Search ..... 292/288, 258, 292/DIG. 2, 256.71, 291

[56] References Cited

U.S. PATENT DOCUMENTS

| | | | |
|---|---|---|---|
| 359,815 | 3/1887 | Sargent | 292/289 X |
| 1,009,131 | 11/1911 | Burdick | 292/256.71 X |
| 1,239,802 | 9/1917 | Macbeth | 292/258 |
| 1,850,602 | 3/1932 | Pineo | 292/DIG. 2 X |
| 1,888,425 | 11/1932 | Dowling | 292/291 |
| 2,288,022 | 6/1942 | O'Brien et al. | 292/291 |
| 3,367,700 | 2/1968 | Carnicero | 292/288 |
| 3,458,228 | 7/1969 | White | 292/288 X |
| 3,929,362 | 12/1975 | Petroff | 292/291 |
| 4,254,976 | 3/1981 | Shoberg . | |
| 4,334,705 | 6/1982 | Rumph | 292/288 |
| 4,386,797 | 6/1983 | Duran . | |
| 4,955,648 | 9/1990 | Miller . | |

*Primary Examiner*—Rodney M. Lindsey
*Attorney, Agent, or Firm*—Joseph F. Long

[57] ABSTRACT

Small portable mechanical units manually installable to provide an auxiliary lock for outward opening doors such as are normally used on motor homes etc are disclosed. Embodiments are included that are useable on doors with various types of latching mechanisms.

3 Claims, 3 Drawing Sheets

AUXILIARY DOOR LOCK FOR AN OUTWARDLY OPENING DOOR

BACKGROUND OF THE INVENTION

At present there seems to an ever increasing need for personal security. This invention is intended to allow a person to have a simple device that will provide an auxiliary or primary means for locking or immobilizing outwardly opening or inwardly closing doors such as generally found in motor homes or similar vehicles.

In search of prior art we find some door restraint mechanisms but none that serve to anchor a relatively light door firmly in place from the inside as we do in this invention. The present invention uses the door knob or door latch or eye bolt through the door as anchor or pivot point to pull the door inward. This auxiliary lock will hold even a light weight door in such a fashion that forced entry would create considerable noise and require considerable force. This noise should awaken and warn a sleeping occupant.

The invention, in a preferred embodiment to use with doors having a door knob comprises a box-like body to slide under and over the knob with a forward extension of the box-like body projecting over the door frame and with a manual tightening unit threaded through the rearward end of the unit. Tightening this unit pulls the knob inward and immobilizes the door. Other embodiments are used for doors with different type latches.

We realize that many minor mechanical modifications may be made to the units of this invention and wish to be limited only to the general spirit and purpose as outlined in these specifications and claims.

BRIEF SUMMARY OF THE INVENTION

In a preferred embodiment of the invention the box shaped body of the unit has a slot to allow the unit to slide over a doorknob and in this position a beginning end is shaped to fit over the adjacent door frame. A threaded bolt or post goes through the body of the unit on the opposite end and is rotatably connected with a pad to allow tightening the threaded post to pull the door knob inward.

In second embodiment, to primarily be used where there is a door latch but no door knob, the body of the unit may be fastened to the door with a hook and eyebolt. The body of the hook is threaded but slides through the unit into the threaded eye to adjustably hold the unit in place. The beginning end of the unit is extended and shaped to fit against the adjacent door jamb. At the opposite end a threaded bolt threads through the body of the unit and may be tightened against the door to pull the door inward. The hook and eye acts as a pivot point and as the knob or lever on the tightening unit is tightened the door is pulled firmly against the doorjamb and held in place until manually loosened from the inside. In the third embodiment the central pivot point may be similar to an open box to fit over a lever-type door latch, with a beginning end and threaded tightening unit similar to the first embodiment, the lever-type door latch may be rendered immobile and also pulled firmly inward.

DETAILED DESCRIPTION OF THE INVENTION

The invention may best be described from the drawings. Three embodiments are shown. All embodiments are similar with minor differences as necessary to easily install on doors with different latching mechanisms.

Figure 1:
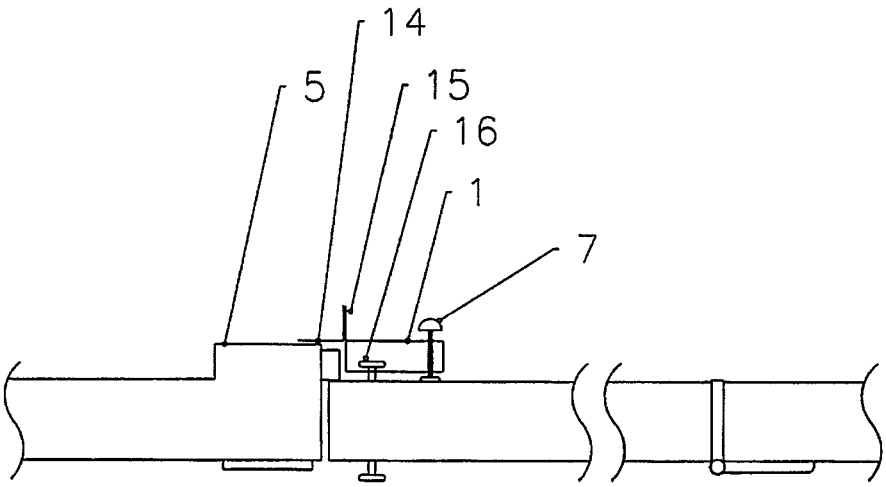
FIG. 1 shows a top view of one preferred embodiment indicating how the unit may be slipped over a door knob and tightened to prevent the door from moving outward.
Figure 2:
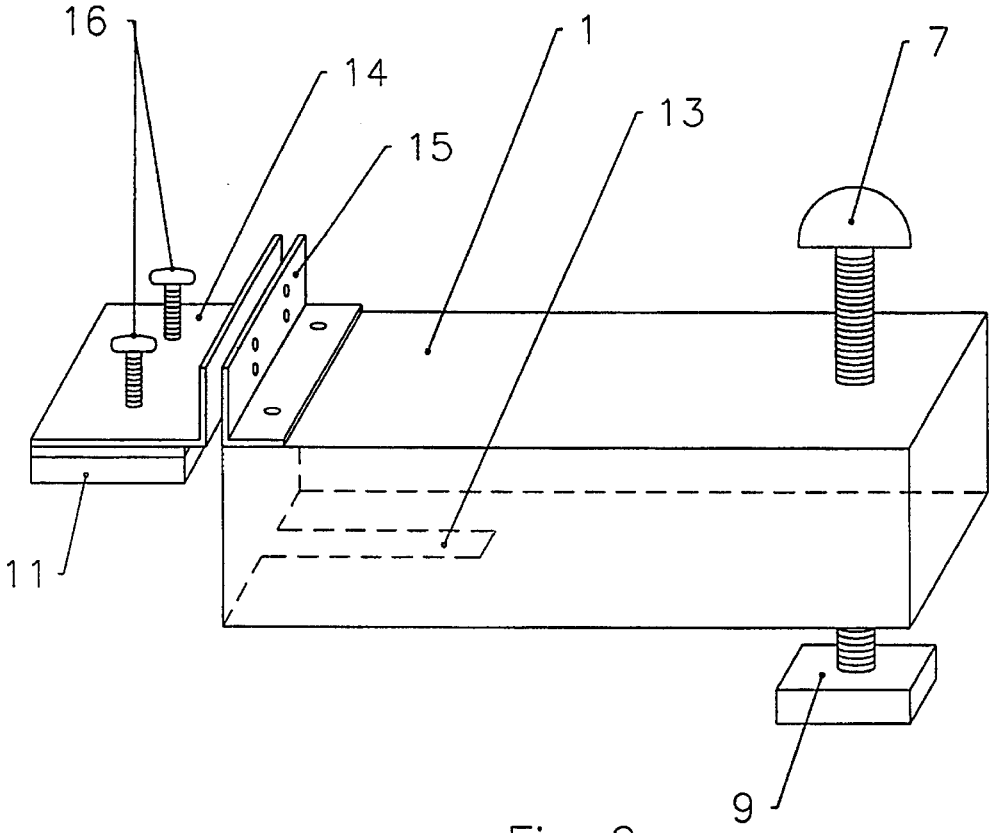
FIG. 2 shows a three dimensional view to indicate details of unit shown in FIG. 1.

In FIGS. 1 and 2 we show a preferred embodiment of the unit 1 to be used with an outward opening door 3 that has a door knob 6. Slot 13, FIG. 2 allows the unit 1 to slide over and enclose door knob 6. Height adjustment unit 15 may consist essentially of an angle iron with holes to match holes in door jamb pressure unit 14. Unit 14 is equipped with a metal pad with a resilient bottom face 11 threadably connected with threaded posts 16. The distance between surface of door jamb 5 and surface of door 3 may differ significantly. As shown unit 14 may be adjusted upward or downward by moving bolts (not shown) to bolt 14 to adjustment unit 15. Unit 14 may be turned over by removing threaded posts 16 and putting pad 11 on the reverse side. This allows a large variation in the distance between surface of door jamb 5, FIG. 1 and surface of door 3. With the unit in place and pad 11 loosely adjusted against the door jamb 5 then manually tightening of threaded post 7 will cause the door knob 6 to act as a pivot point and as tightening proceeds be pulled tightly inward; thereby preventing outward motion of door 3. Pad 9 is loosely and rotatably held to post 7.

Figure 3:
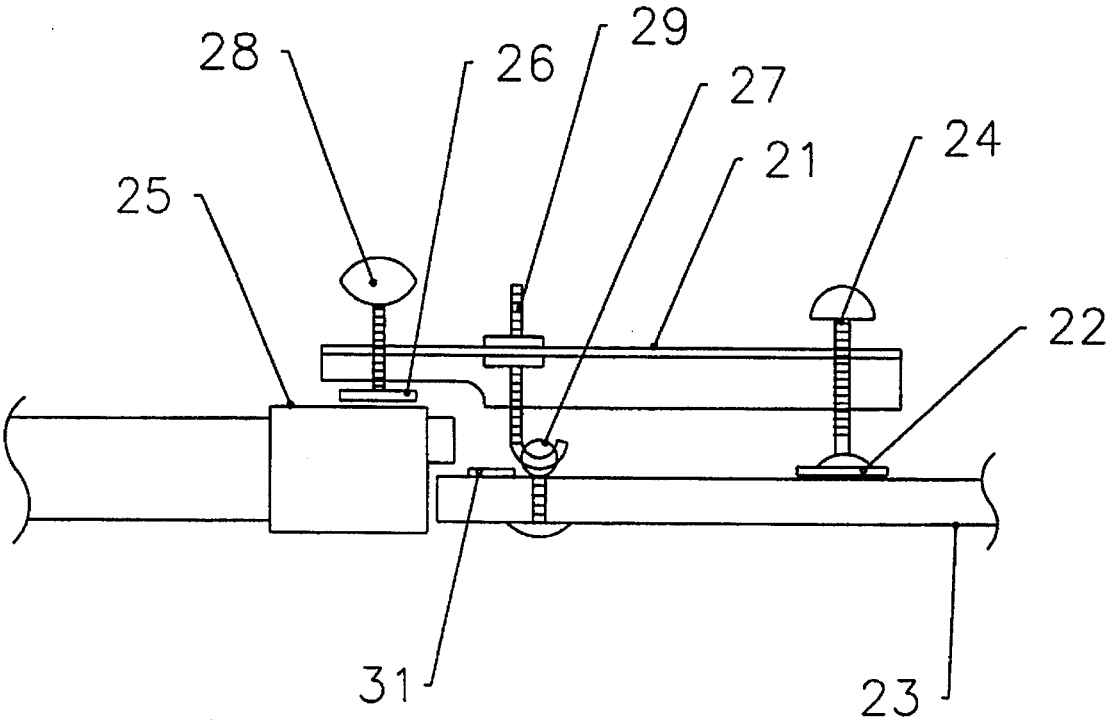
FIG. 3 shows a second embodiment of a unit wherein the pivot point is a hook and eyebolt to allow pulling finger latch type doors inward.
Figure 4:
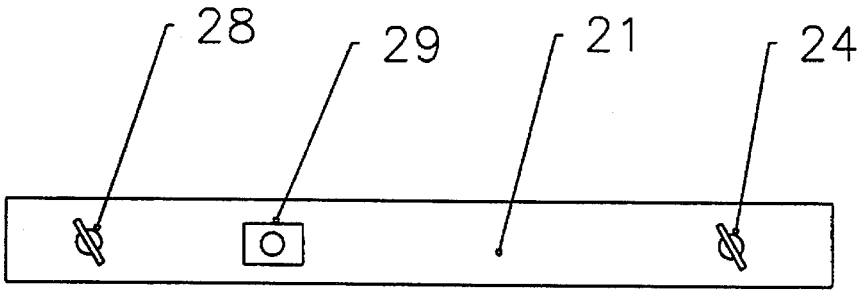
FIG. 4 is a top view of the second embodiment.

In FIGS. 3 and 4 we show a second embodiment designed for doors with a finger type latch that would be difficult to attach to for use as a pivot point. As shown in FIG. 3 eyebolt 27 may be installed through door 23 and left in place. Threaded hook 29 may be adjusted in length through the top angle of unit body 21 and put loosely in place. The door jamb pad 26 height adjustment may be made loosely to hold the unit in place and tightener 24 that threadably engages the top angle of unit body 21 may be hand tightened to pull and hold door 23 firmly against door jamb 25. FIG. 4 shows a top view of unit 21. The distance between pivot point hook and eye unit 29 and tightener unit 24 changes the leverage pulling the door inward as may be seen in FIG. 3.

Figure 5:
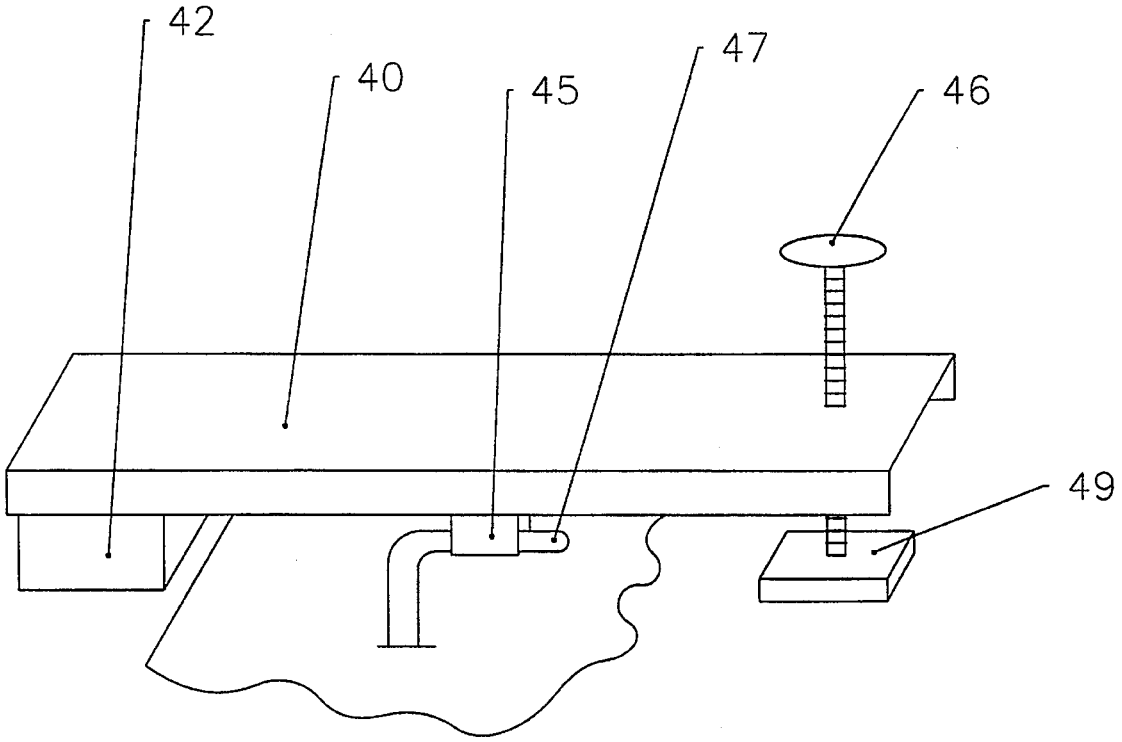
FIG. 5 shows a third embodiment suitable for use on doors having a lever type door latch instead of a door knob.

In FIG. 5 we show a third embodiment for use on outwardly opening doors with a lever type latch. In this embodiment we've shown the main body 40 as a channel shape but other shapes with sufficient rigidly would be equally useable. On the underside of body 40 a box-like unit 45 is attached to body 40 and is sized to slide over door lever 47. In this embodiment we've shown pressure pad 42 as a solid unit attached to body 40 but an adjustable pad as indicated an other embodiments could be used to increase versatility of use. Tightener unit 46 with pad 49 may be tightened to pull lever 47 inward and immobilize the door attached to lever 49.

What is claimed is:

1. An auxiliary lock for outwardly opening doors comprising:

a) a box-like body means with a slot on a lower side of a first end allowing an upper side of said body means to slide over and said lower side of said first end to slide under a doorknob;

b) a tightener bolt threadably installed through a second end of said body means;

c) a door jamb pressure means adjustably connected with said first end of said body means; said door jamb pressure means acting to prevent said door from opening when said tightener means is tightened to raise said second end of said body means to exert pressure to hold said door in a closed position.

2. An auxiliary lock for outwardly opening doors as in claim 1 wherein said door jamb pressure means is a height adjustable metal pad with a resilient bottom face attached thereto.

3. An auxiliary lock for outwardly opening doors as in claim 1 wherein said tightener means is a threaded post with an upper knob and a rotatably attached bottom pad; said threaded post being threaded through said box-like body means.

* * * * *